US006296120B1

(12) United States Patent
Danko

(10) Patent No.: US 6,296,120 B1
(45) Date of Patent: Oct. 2, 2001

(54) MULTIPLE PASTRY BOX

(75) Inventor: Ronald D. Danko, Pittsford, NY (US)

(73) Assignee: Wegman's Food Markets, Inc., Rochester, NY (US)

( * ) Notice: Subject to any disclaimer, the term of this patent is extended or adjusted under 35 U.S.C. 154(b) by 0 days.

(21) Appl. No.: 09/499,615

(22) Filed: Feb. 7, 2000

(51) Int. Cl.[7] ..... B65D 1/34

(52) U.S. Cl. ..... 206/564; 206/589; 229/906; 426/128

(58) Field of Search ..... 206/521.6, 524, 206/564, 589; 229/902, 906; 426/128, 392

(56) References Cited

U.S. PATENT DOCUMENTS

| | | | | |
|---|---|---|---|---|
| 1,267,388 | | 5/1918 | Dodson . | |
| 1,493,796 | | 5/1924 | Anderson . | |
| 1,818,908 | | 8/1931 | Pouchain et al. . | |
| 1,862,980 | | 6/1932 | Prather et al. . | |
| 1,994,214 | | 3/1935 | Frost . | |
| 2,170,060 | | 8/1939 | Meyer . | |
| 2,326,013 | | 8/1943 | Damrow . | |
| 2,326,014 | | 8/1943 | Damrow . | |
| 2,617,577 | * | 11/1952 | Tardiff | 229/906 |
| 2,761,785 | | 9/1956 | Steger . | |
| 2,919,844 | * | 1/1960 | Andersen, Jr. . | |
| 3,645,758 | | 2/1972 | MacManus . | |
| 3,874,548 | * | 4/1975 | Buff, Jr. | 229/906 |
| 3,949,930 | | 4/1976 | Giordano . | |
| 4,114,760 | | 9/1978 | Entenmann . | |
| 4,375,862 | | 3/1983 | Kurinsky et al. . | |
| 4,644,858 | | 2/1987 | Liotto et al. . | |
| 4,649,053 | | 3/1987 | Lamonica . | |
| 5,605,646 | | 2/1997 | Colombo et al. . | |
| 5,706,966 | | 1/1998 | Rothe . | |
| 5,888,565 | | 3/1999 | Gics . | |
| 5,900,264 | | 5/1999 | Gics . | |
| 5,912,033 | | 6/1999 | Ferguson . | |
| 6,003,671 | * | 12/1999 | McDonough et al. | 206/564 |

* cited by examiner

*Primary Examiner*—David T. Fidei
(74) *Attorney, Agent, or Firm*—Jaeckle Fleischmann & Mugel, LLP

(57) ABSTRACT

A container assembly for carrying display-packaged delicate baked goods includes a container having opposing side walls interconnected with opposing end walls, a bottom interconnected with each of the side and end walls, a top, and an interior. A retaining tray has at least one aperture therein, and is removably received in the container interior. The retaining tray is dimensioned such that the container side and end walls restrict movement of the retaining tray in a direction perpendicular to the container side and end walls. The retaining tray includes at least one spacing member extending therefrom and spacing the retaining tray from an underlying surface. A display package includes a pan portion and a top removably secured to the pan portion. The pan portion includes a projection extending outwardly therefrom, and is removably received within the aperture until the projection contacts the retaining tray. The projection is disposed on the pan portion such that the display package is suspended from the retaining tray within the aperture above the underlying surface, thereby restricting the display package from movement in a direction perpendicular to the container side and end walls and in a direction toward the bottom of the container.

15 Claims, 2 Drawing Sheets

MULTIPLE PASTRY BOX

FIELD OF THE INVENTION

The present invention relates to containers and, more particularly, to containers for the storage and transportation of baked goods.

DESCRIPTION OF THE RELATED ART

Baked goods, such as pastries, cakes, and pies, are delicate items which are easily damaged during the shipping and handling thereof Furthermore, such baked goods are known as "impulse" items because a consumer often purchases baked goods without the prior intention of so doing. In order to increase the likelihood of creating the impulse to buy within the consumer, baked goods are prominently and attractively displayed in a high-traffic area of a retail establishment. The buying impulse is created by appealing to the consumer's senses of sight and smell. Aesthetics are a critical factor in the creation within the consumer of the impulse to purchase a baked good. An aesthetically appealing baked good is much more likely to create the buying impulse within a consumer than an unattractively displayed baked good or one with degraded aesthetics. The aesthetics of baked goods can be negatively impacted due to their delicate nature. Thus, it is desirable to preserve and protect the aesthetic quality of baked goods.

Many bakeries supply baked goods to a number of geographically-dispersed customers such as restaurants and retail outlets. The distribution channel may include, for example, a central bakery which produces large quantities of baked goods. The baked goods are then placed in shipping containers for distribution, and delivered to the customer location by, for example, a delivery truck. Once at the customer location, the shipping containers which contain the baked goods are then carried by hand or upon a wheeled cart from the delivery truck to a location within the retail outlet. During transportation from the bakery to the customer, the shipping containers may be stacked one on top of another, and are likely to encounter relatively rough handling which may result in the baked goods suffering some degradation in aesthetic quality.

Various individual display packages have been developed which enable the aesthetic display of an individual baked good at the point of sale by affording the consumer a relatively unobstructed view of the contents of the package. However, the individual display packages do not effectively protect baked goods during the distribution thereof from the central bakery to the customer location. The protective properties of the typical individual display package are sacrificed in order to achieve the desired aesthetic or display qualities. Such individual display packages may not be stacked one on top of another, nor may they be packed in quantity within a shipping container, without damaging the display package or the baked goods therein which, in turn, degrades the aesthetics of the baked good. Therefore, baked goods are typically packaged in small quantities. Very delicate baked goods, such as pastries, tend to be packaged individually. Even the individually packaged baked goods, however, still require very careful handling if their aesthetic appeal is to be preserved.

Even with careful handling, the individual display packages may shift within the delivery truck or within shipping containers during distribution. Such shifting often results in damage to the baked goods or in damage to the individual display packages. Damage to either the baked good or its display package degrades the overall attractiveness of the display of the baked good, reduces the aesthetic quality thereof, and therefore reduces the likelihood of creating the buying impulse within a consumer.

The above factors result in various inefficiencies within the distribution channel. Valuable delivery truck space is wasted due to an inability to stack boxes. Other examples of such inefficiencies include the additional hours of labor required to accomplish delivery due to the small quantities of baked goods contained in each package, an increased number of trips are required to deliver a given quantity of baked goods, and the special care which must be taken by a delivery person in order to minimize damage to the baked goods. Furthermore, due to damage in transit and delivery, shrinkage occurs from the amount of product which leaves the central bakery to the amount of product which reaches the customer in saleable condition and without loss of aesthetic quality. Such inefficiencies all result in higher operating costs and lower profits.

Therefore, what is needed in the art is a shipping container which enables the shipment of a relatively large quantity of delicate baked goods and which protects the baked good from damage. Furthermore, what is needed in the art is a shipping container which enables the shipment of a relatively large quantity of individually display-packaged delicate baked goods and which preserves the aesthetic appearance of the baked good and its individual display package.

SUMMARY OF THE INVENTION

The present invention provides a multiple pastry box which permits the packing and shipping of a quantity of individually display-packaged pastries within a single carton, and which protects the pastries and the individual display packages from damage, thereby preserving their aesthetic quality.

The invention comprises, in one form thereof, a container assembly, including a container having opposing side walls interconnected and spaced apart by opposing end walls, a bottom interconnected with the side and end walls, a top, and an interior. A retaining tray defines at least one aperture and is removably received in the container interior. The retaining tray is dimensioned such that the container side and end walls restrict movement of the retaining tray in a direction perpendicular to the container side and end walls. The retaining tray includes at least one spacing member extending therefrom and spacing the retaining tray a predetermined distance from an underlying surface. A display package includes a pan portion and a top removably secured to the pan portion. The pan portion includes at least one projection extending outwardly therefrom, and is removably received within the aperture until the projection contacts the retaining tray. The projection is disposed on the pan portion such that the display package is suspended from the retaining tray within the aperture and above the underlying surface, thereby restricting the display package from movement in a direction perpendicular to the container side and end walls and in a direction toward the bottom of the container.

An advantage of the present invention is that the display-packages are restricted from horizontal displacement during packaging, handling and transport.

Another advantage of the present invention is that the display packages are restricted from vertical movement during packaging, handling and transport.

Yet another advantage of the present invention is that the aesthetic quality of the display packages is preserved during packaging, handling and transport.

A still further advantage of the present invention is that a large quantity of display packages containing delicate baked goods may be shipped within one container without degraded aesthetics.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE DRAWINGS

Figure 1:
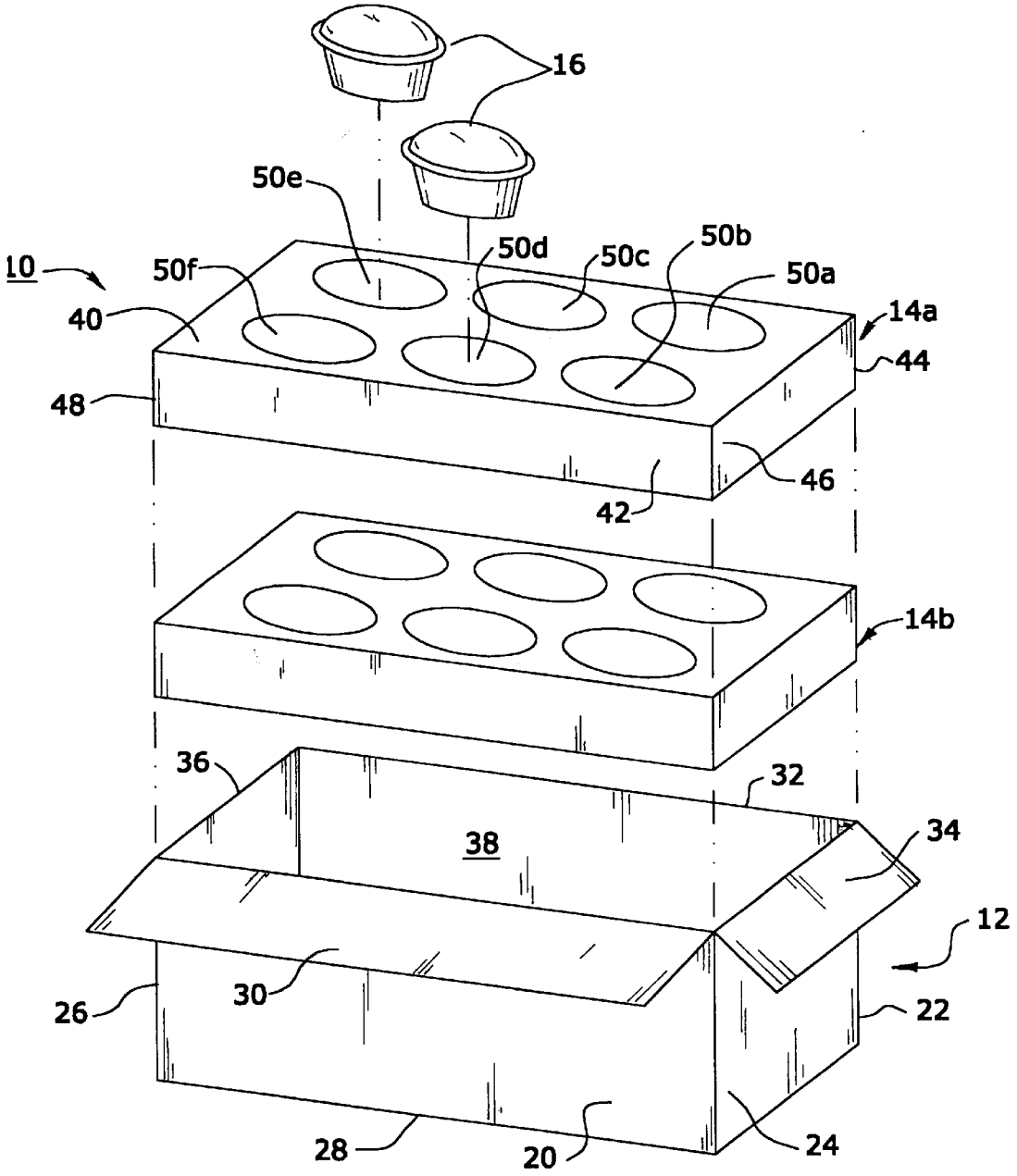
FIG. 1 is an exploded perspective view of one embodiment of a multiple pastry box of the present invention.

Referring now to the drawings and particularly to FIG. 1, there is shown a multiple pastry box 10 including container 12, retainer trays 14*a* and 14*b*, and display packages 16.

Container 12 includes opposing side walls 20, 22, end walls 24, 26, bottom 28 and a top portion having two side flaps 30, 32 and two end flaps 34, 36, all of which conjunctively define box interior 38. Container 12 is closed by folding end flaps 34, 36 inward toward the interior 38 until the flaps are substantially parallel with bottom 28. Then, side flaps 30, 32 are likewise folded inward toward box interior 38 until they are substantially parallel with bottom 28. The side flaps 30, 32 will thus overlie end flaps 34, 36. The side flaps 30, 32 form a junction therebetween which extends the entire length of the top of container 12. The container 12 can then be securely closed by, for example, applying tape over side flaps 30, 32. The tape preferably is applied such that it covers the junction or intersection of flaps 30, 32, thereby joining the flaps together along a substantial length of the junction formed therebetween, and then extends onto end walls 24, 26. Container 12 is opened by cutting or removing the tape and reversing the process described above, i.e., the side flaps 30, 32 are folded out relative to interior 38 and, thereafter, the end flaps 34, 36 are also folded out relative to interior 38, thereby rendering accessible any contents previously placed in interior 38. The bottom 28 of container 12 can, for example, be formed of flaps similarly to the top or, alternatively, formed of a solid one-piece construction. Container 12 is formed of, for example, corrugated cardboard or other suitable material, and is dimensioned to contain a predetermined number of baked goods.

Figure 2:
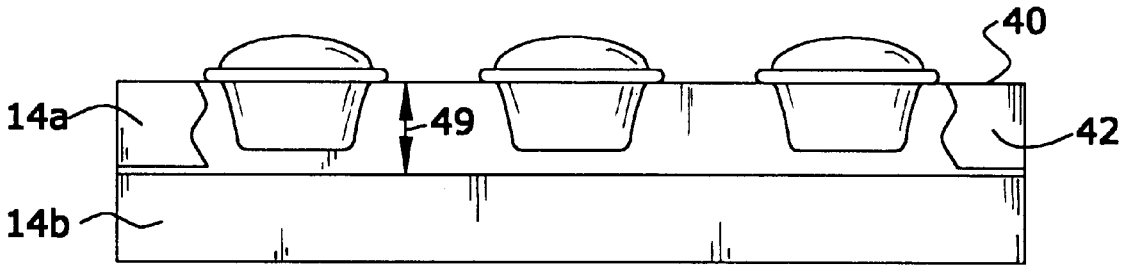
FIG. 2 is a side, partially sectioned view of the retainer trays and display packages of FIG. 1.
Figure 3:
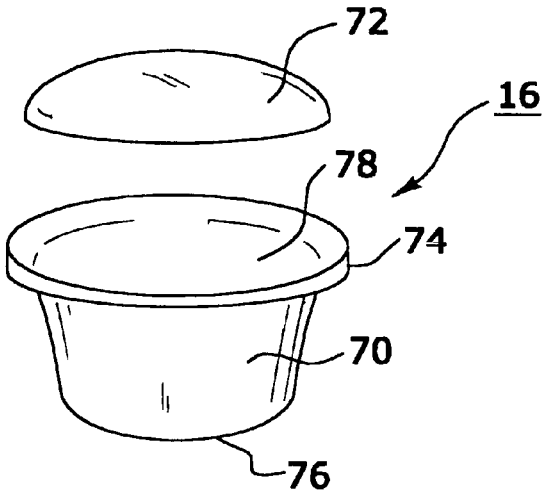
FIG. 3 is a perspective view of a display package of FIG. 1.

Retainer trays 14*a* and 14*b* are of substantially identical construction and, therefore, only retainer tray 14*a* will be described in detail, such description being equally applicable to retainer tray 14*b*. Referring now to FIG. 2, retainer tray 14*a* includes planar top member 40, side walls 42, 44, and end walls 46, 48. Retainer tray 14*a* is designed to fit snugly within container 12 and is therefore dimensioned such that there is only a slight clearance between retainer side walls 42, 44 and container side walls 20, 22, and between retainer end walls 46, 48 and container end walls 24, 26. The minimal clearance between the side and end walls of retainer tray 14*a* and the container side and end walls 42, 44 and 46, 48, respectively, ensures retainer tray 14*a* will not be displaced in the horizontal plane when disposed in interior 38 of container 12. Retainer tray 14*a* is constructed of, for example, corrugated cardboard, paperboard, or, alternatively, injection molded plastic. Retainer tray 14*a* may be constructed by the folding or forming of one piece of, for example, cardboard or paperboard, or may be constructed of separate pieces of material attached or connected together.

Side walls 42, 44 of retainer tray 14*a* are substantially perpendicular to top planar member 40. Likewise, end walls 46, 48, are substantially perpendicular to planar member 40. Side walls 42, 44 and end walls 46, 48 enable stacking of one retainer tray on top of another. When the retainer trays are stacked one on top of another, side walls 42, 44 and end walls 46, 48 create a vertical separation 49 between the respective planar members 40 of each retainer tray. The height of side walls 42, 44 and end walls 46, 48 determines the vertical separation or space 49 created between the respective planar top members of the stacked retainer trays.

Planar member 40 defines, for example, six apertures 50*a*, 50*b*, 50*c*, 50*d*, 50*e* and 50*f* therein. Apertures 50*a*–50*f* are, for example, substantially cylindrical in shape, each being dimensioned to receive and support one of display packages 16. In general, the shape of the aperture corresponds to the shape of the package 16.

Display packages 16 include a pan portion 70, cover 72 and flange 74. Pan 70 includes a closed bottom portion 76 and an open top portion 78. Flange 74 is integral with pan 70 and extends radially-outward therefrom. Flange 74 is disposed, for example, near the open top portion 78 of pan 70. Cover 72 is removably secured to the open top portion 78 of pan 70 by use of, for example, projections (not shown) which snap through complementary features (not shown) in pan 70. Alternatively, cover 72 can be constructed in a way, or from a material, which renders it elastically deformable. Cover 72 can then be removably secured to pan 70 by elastic deformation over a complementary feature such as, for example, a ridge or ring (not shown) formed around the open top 78 of pan 70. Display packages 16 are, for example, cylindrical in shape, having a slightly outward flare, and are constructed of, for example, a transparent plastic in order to aesthetically display a baked good contained therein.

Flange 74 is disposed, for example, around the entire perimeter of pan 70 proximate to the open top 78 thereof. Apertures 50*a*–50*f* are dimensioned to receive pan 70 of display package 16. However, flange 74 extends radially outward from pan 70 such that flange 74 does not pass through apertures 50*a*–50*f*. Rather, flange 74 interferes with the outer perimeter of apertures 50*a*–50*f* and rests on flat planar member 40 of retainer tray 14. Thus, pans 70 are suspended from planar member 40 within apertures 50*a*–50*f* by their respective flanges 74. When the retainer trays are stacked, the portion of the pan 70 below flange 74 is disposed between the stacked retainer trays 14*a* and 14*b*, within the space 49 created by side walls 42, 44 and end walls 46, 48. The vertical separation or space 49 between the stacked retainer trays 14*a*, 14*b* can be adjusted by changing the height of side walls 42, 44 and/or end walls 46, 48 during manufacture thereof. Thus, various depths of pans 70 and various heights of covers 72 can be accommodated. Furthermore, virtually any size or shape of pan 70 can be accommodated by changing the shape and dimensions of apertures 50*a*–50*f*.

In use, container 12 is supplied to an end user in, for example, a ready-to-use form, or in a flat or condensed form requiring some assembly. When supplied in a flat or condensed form efficiencies of shipping are realized. When containers 12 are supplied in the flat or condensed form, the top end and side flaps, and a bottom are pre-cut and creased to simplify assembly of container 12. Assembly is accomplished by closing the bottom 28 of container 12. Bottom 28 is closed, for example, by a procedure similar to that described above for the closing of top flaps 30–36. Bottom end flaps (not shown) are folded inward until the end flaps are substantially perpendicular to end and side walls 24, 26 and 20, 22, respectively. Bottom side flaps (not shown) are then folded inward, over the bottom end flaps, until the bottom side flaps are substantially perpendicular to the end and side walls 24, 26 and 20, 22, respectively. The bottom of container 12 is then closed by, for example, applying tape to the junction formed between the bottom side flaps and then onto end walls 20, 22. Container 12 is thus ready to receive display-packaged backed goods for delivery.

Retainer trays 14*a* and 14*b* may also be supplied in a pre-formed or in a flat or condensed form. If supplied in the flat or condensed form, side walls 42, 44 and end walls 46, 48 are pre-cut and creased to simplify assembly. Furthermore, interlocking features (not shown) are also pre-formed in the flat for retainer trays 14*a* and 14*b*, further simplifying assembly thereof. Assembly of retainer tray 14*a* is accomplished by folding side walls 42, 44 until they are substantially perpendicular to planar member 40. End walls 44, 46 are likewise folded, in the same direction as side walls 42, 44, until they are substantially perpendicular to planar member 40. The end walls 44, 46 and side walls 42, 44 are interconnected by, for example, tape or an interlocking feature integral therewith.

Once assembled, retainer tray 14*a* is placed within interior 38 of container 12. Then, pans 70 of display packages 16, which contain finished or partially finished baked goods, are then placed into a respective one of apertures 50*a*–50*f*. The covers 72 may have already been attached to pans 70, or may be attached at this point. Display packages 16 are received within a respective one of apertures 50*a*–50*f* until flange 74 contacts the outside perimeter of that respective aperture and/or planar member 40, thereby preventing any further downward displacement of display package 16. Thus, display package 16 is suspended by flange 74 within a respective aperture from planar member 40. The portion of pan 70 below flange 74 is disposed in the space 49 formed by the separation created between planar member 40 and the bottom of container 12 by side walls 42, 44 and/or end walls 46, 48 of retainer tray 14*a*. The minimal clearance between retainer side walls 42, 44 and container side walls 20, 22, and between retainer end walls 46, 48, and container end walls 24, 26, respectively, ensures retainer tray 14*a* will not be displaced in a direction perpendicular to side and end walls 20, 22, and 24, 26, respectively, when disposed in interior 38 of container 12. The placement of display package 16 within a respective one of apertures 50*a*–50*f* ensures display package 16 will not be displaced in a direction perpendicular to side and end walls 20, 22, and 24, 26, respectively. Furthermore, the suspension of display package 16 by flange 74 from retaining tray 14*a* prevents the downward displacement of display package 16.

A second retainer tray 14*b* is then assembled and placed into container 12. Side walls 42, 44 and/or end walls 46, 48 of retainer tray 14*b* act to vertically space apart the respective planar members 40 of retainer tray 14*a* and retainer tray 14*b*. Pans 70 and/or display packages 16, containing finished or partially finished baked goods, are then placed within a respective one of apertures 50*a*–50*f* of retainer tray 14*b*. The spacing between retainer tray 14*a* and 14*b* is chosen such that display packages 16 within retainer tray 14*a*, prevented from downward displacement by flanges 74, are further prevented from upward movement by the overlying retainer tray 14*b* and/or the display packages 16 contained therein.

This process of placing retainer trays into container 12 and placing pans 70 and/or display packages 16 into the apertures of the retainer tray is repeated until container 12 has reached its capacity. Container 12 is then closed as described above.

In the embodiment shown, the top of container 12 is shown as being integral with container 12 and including flaps 30–36. However, it is to be understood that the top of container 12 may be alternatively formed as one piece of material integral with, or separate from, container 12.

Apertures 50*a*–50*f*, in the embodiment shown, are shown and described as being cylindrical in shape. However, it is to be understood that the apertures may be of virtually any shape which corresponds to the particular display package being placed therein.

In the embodiment shown, container 12 and retainer trays 14*a*, 14*b*, are shown and described as being constructed of cardboard and/or paperboard. However, it is to be understood that container 12 and retainer trays 14*a*, 14*b* can be alternatively constructed out of, for example, injection molded plastic, sheet metal, or virtually any other suitable material.

In the embodiment shown, Flange 74 is shown and described as disposed proximate to the open top 78 of pan 70 of display package 16. However, it is to be understood that flange 74 may be disposed at other points along the outside of pan 70. Furthermore, flange 74 is disclosed as being disposed around the entire perimeter of pan 70. It is to be understood that flange 74 can be disposed around only a portion of the perimeter of pan 70 and still perform its intended function. Moreover, flange 74 may alternatively be formed as simple projections or stubs extending radially outward from pan 70.

Cover 72 of pan 70 is, in the embodiment shown, disclosed as including projections (not shown) which snap into corresponding features (not shown) on pan 70, or as elastically snapping over a ridge disposed proximate to open top 78 of pan 70. However, it is to be understood that cover 72 may also be configured to elastically deform or snap over flange 74. Furthermore, cover 72 may include a portion of or form a portion of flange 74.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A container assembly, comprising:

a container having opposing side walls interconnected with and spaced apart by opposing end walls, a bottom interconnected with each of said side walls and said end walls, a top, and an interior defined by said side walls, said end walls and said bottom;

at least one retaining tray defining at least one aperture therein, said at least one retaining tray being removably received in said interior of said container and being dimensioned such that said side walls and said end walls restrict movement of said retaining tray in a direction perpendicular to said side walls and said end walls, said retaining tray including at least one spacing member extending therefrom and spacing said retaining tray a predetermined distance from an underlying surface; and at least one display package having a pan portion and a top removably secured to said pan portion, said pan portion including at least one projection extending outwardly therefrom, said at least one display package being removably received within said aperture until said projection contacts said retaining tray, said projection being disposed on said pan portion such that said display package is suspended from said retaining tray within said aperture above said underlying surface, said display package thereby being restricted by said aperture from movement in a direction perpendicular to said side walls and said end walls and restricted from movement by said projection in a direction toward said bottom of said container.

2. The container assembly of claim 1, wherein said opposing side walls and said opposing end walls of said container comprise one continuous side wall, said bottom being interconnected with said side wall.

3. The container assembly of claim 1, wherein each of said at least one aperture has a shape corresponding to a shape of said pan suspended therein.

4. The container assembly of claim 1, wherein said pan includes a bottom interconnected with a substantially cylindrical side wall thereby defining an open end opposite said bottom, said projection comprising a flange disposed proximate to and around at least a portion of said open end.

5. The container assembly of claim 4, wherein said side wall of said pan includes a first diameter proximate to said bottom of said pan and a second diameter proximate to said open end of said pan, said second diameter being greater than said first diameter.

6. The container assembly of claim 1, wherein said pan includes opposing side walls interconnected and spaced apart by opposing end walls, and a bottom interconnected with each of said side walls and said end walls thereby defining an open end opposite said bottom, said projection comprising a flange disposed proximate to and around at least a portion of said open end.

7. The container assembly of claim 1, wherein said at least one aperture comprises a plurality of apertures.

8. The container assembly of claim 1, wherein said at least one retaining tray comprises a flat planar member.

9. The container assembly of claim 8, wherein said flat planar member includes two opposing end rails which interconnect and space apart two opposing side rails, said flat planar member interconnected with each of said two end rails and said two side rails, said flat planar member defining said at least one aperture therein.

10. The container assembly of claim 8, wherein said side rails and said end rails cooperate with said side walls and said end walls of said container to restrict displacement of said retaining tray in a direction perpendicular to said side walls and said end walls.

11. The container assembly of claim 8, wherein said at least one spacing member comprises at least one of said two opposing side rails and said two opposing end rails.

12. The container assembly of claim 1, wherein said at least one retaining tray comprises a plurality of retaining trays, each of said retaining trays being received within said container such that said retaining trays are disposed one on top of another, each of said retaining trays being spaced a predetermined distance apart by said at least one spacing member, each of said retaining trays having at least one display package suspended therefrom within a respective aperture, each of said at least one spacing members being dimensioned such that said predetermined distance is greater than a height of said display packages.

13. The container assembly of claim 1, wherein said container top is integral with said container.

14. The container assembly of claim 1, wherein said container is formed from a flat blank of material, said blank being appropriately cut and scored so as to enable folding and assembly of the blank into a finished container.

15. The container assembly of claim 1, wherein said display package is transparent.

* * * * *